US008099804B2

(12) United States Patent
Gregg

(10) Patent No.: US 8,099,804 B2
(45) Date of Patent: Jan. 24, 2012

(54) THERMALLY INSULATING BLANKET CONSTRUCTED OF INDIVIDUAL FLOATS AND SYSTEM FOR DEPLOYING AND RETRIEVING SAME

(76) Inventor: John M. Gregg, Huntington Beach, CA (US)

( * ) Notice: Subject to any disclaimer, the term of this patent is extended or adjusted under 35 U.S.C. 154(b) by 654 days.

(21) Appl. No.: 12/248,684

(22) Filed: Oct. 9, 2008

(65) Prior Publication Data

US 2010/0088815 A1 Apr. 15, 2010

(51) Int. Cl.
*E04H 4/00* (2006.01)

(52) U.S. Cl. ..... 4/498; 126/566; 441/1; 441/28

(58) Field of Classification Search ..... 4/498–500, 4/503; 126/565, 566; 441/1, 21, 28, 76; 220/218

See application file for complete search history.

(56) References Cited

U.S. PATENT DOCUMENTS

| | | | | |
|---|---|---|---|---|
| 3,938,338 | A * | 2/1976 | Cullen | 405/21 |
| 3,984,881 | A | 10/1976 | Gerlach | |
| 3,984,882 | A | 10/1976 | Forman et al. | |
| 3,998,204 | A | 12/1976 | Fuchs et al. | |
| 4,137,612 | A | 2/1979 | Kelley | |
| 4,270,232 | A * | 6/1981 | Ballew | 4/498 |
| 4,582,048 | A | 4/1986 | Sorensen | |
| 4,875,466 | A | 10/1989 | Slonneger | |
| 5,188,550 | A * | 2/1993 | Oliver | 441/1 |
| 6,571,789 | B1 | 6/2003 | Mora | |
| 6,874,174 | B2 | 4/2005 | Worthington | |

* cited by examiner

*Primary Examiner* — Gregory Huson
*Assistant Examiner* — Janie Christiansen
(74) *Attorney, Agent, or Firm* — Fulwider Patton LLP

(57) ABSTRACT

A blanket of many floats of like configuration and each incorporating a polygonal parametrical rims housing a plurality of radial spokes configured to, in alternate axial relationship, form cells closed at the respective one ends and opening axially at their respective opposite ends. The system of the present of invention includes plumbing with a series of water jets for generating a current to flow fluid in a controlled fashion from and to a storage tank to selectively deploy and retrieve the floats.

22 Claims, 6 Drawing Sheets

FIG. 1
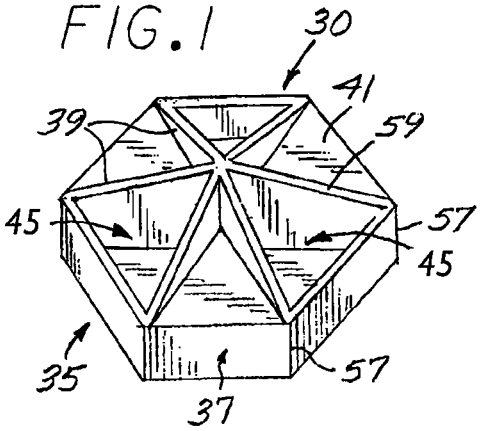
FIG. 2
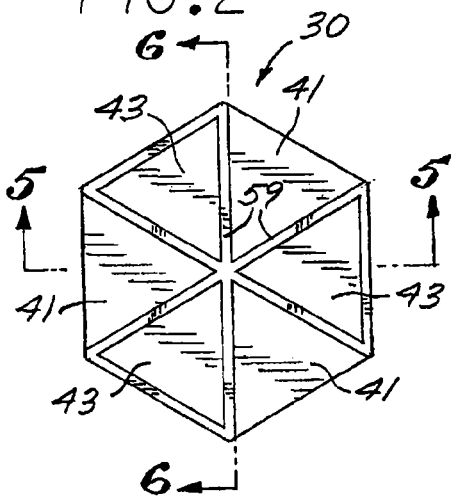
FIG. 3
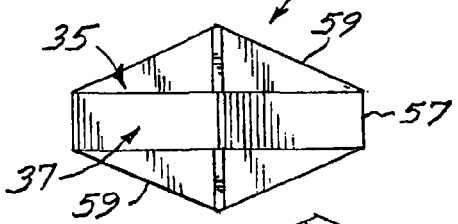
FIG. 4
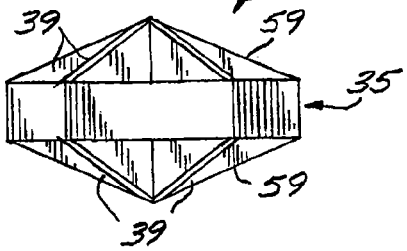
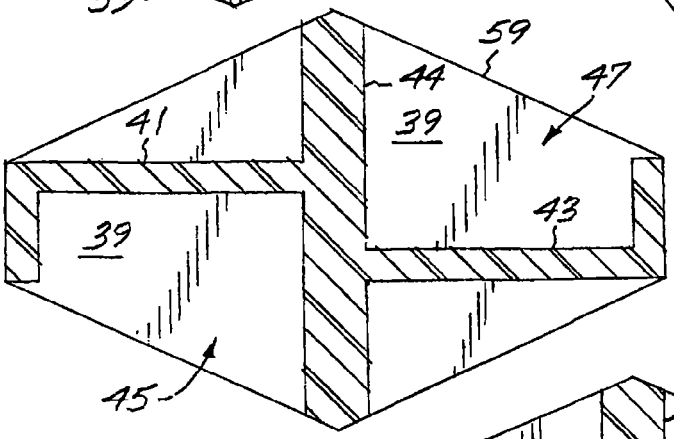
FIG. 5
FIG. 6
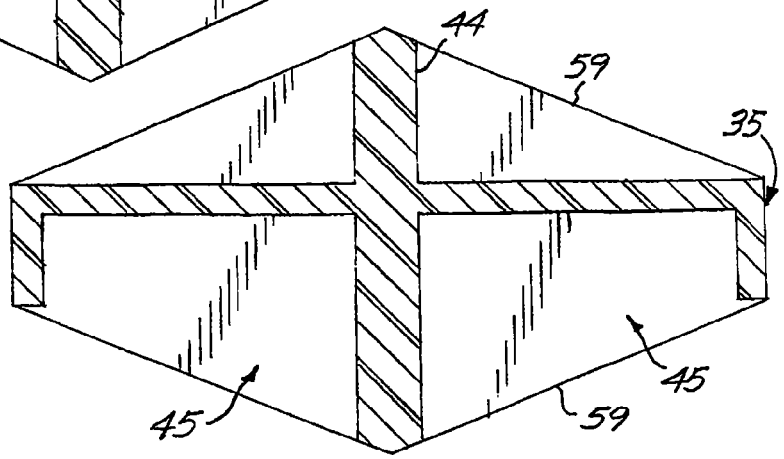

FIG. 12
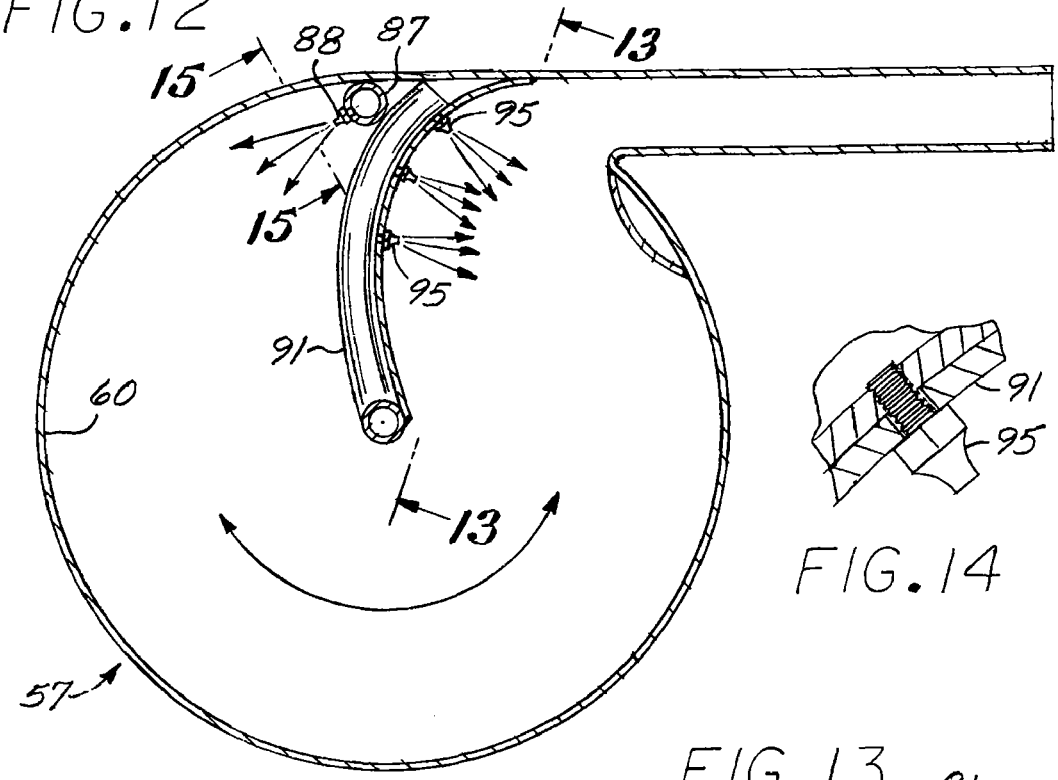
FIG. 14
FIG. 13
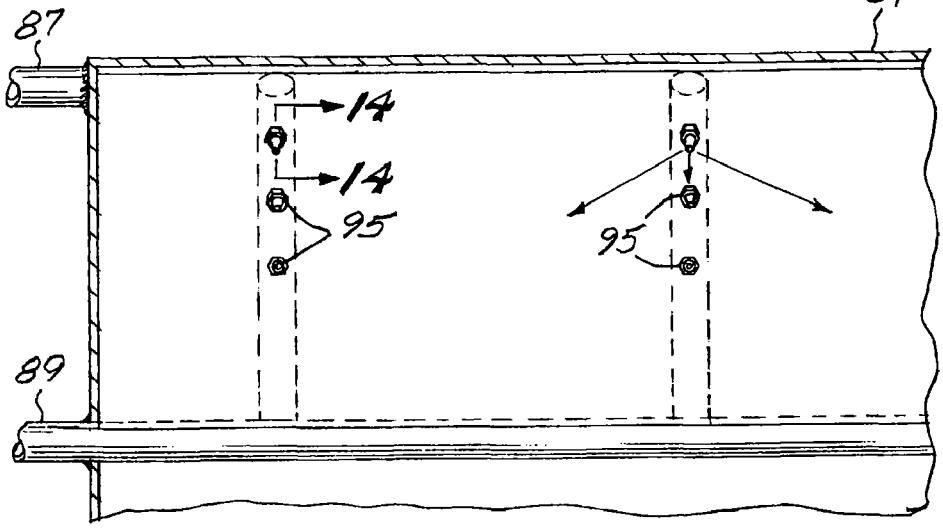
FIG. 15
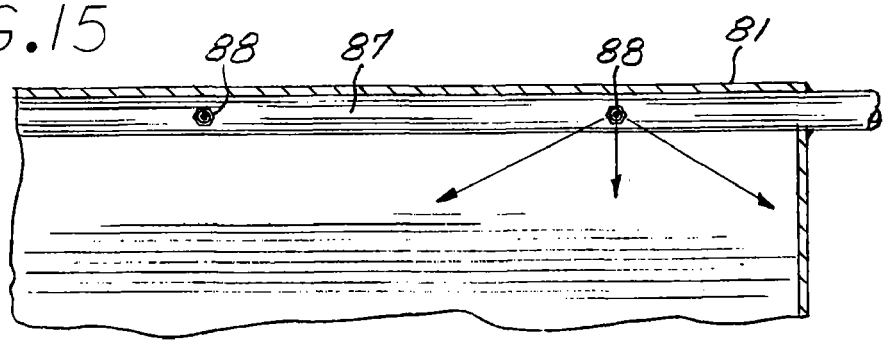

THERMALLY INSULATING BLANKET CONSTRUCTED OF INDIVIDUAL FLOATS AND SYSTEM FOR DEPLOYING AND RETRIEVING SAME

BACKGROUND

1. Field of the Invention

The invention relates to devices for covering the surface of a fluid such as a recreational swimming pool 2. Description of the Prior Art It is well-known it requires an extensive amount of energy to maintain the temperature of a body of fluid, such as swimming pool water, at a desired temperature as the atmospheric temperature varies. In recognition of this need and the desire to limit the extent of evaporation from the surface of the fluid, many efforts have been made to provide a covering for pools and the like which are effective to cover the fluid surface to minimize the escape of heat and to prevent evaporation.

It has been long been recognize that curtain or web type covers are expensive to fabricate and install and can often be cumbersome to deploy. The mechanisms typically associated with deployment and retraction of such covers are often relatively expensive and can lend themselves to deterioration in the moist pool atmosphere and are subject to oxidization and require frequent maintenance and adjusting.

There have also been efforts to control the extent to which solar heat is absorbed in the body of fluid. In recognition of the benefits of solar heating to maintain pool temperature, many efforts have been made to provide solar blankets or the like with heat absorbing material for covering the surface of the pool. Examples of such blankets exist in U.S. Pat. Nos. 3,893,433, 3,453,666 and 3,072,920.

These prior art covers and blankets suffer the shortcoming that they are cumbersome to deploy and retract, a task which can be particularly challenging for irregularly shaped pool such as those with a kidney shape or the like not lending themselves to convenient coverage by a polygonal blanket.

In recognition of these shortcomings it has been proposed to provide for covering of the pool by thermally insulated buoyant balls, or the like, which are intended to be floated unto the pool surface and to cooperate in providing a thermal insulator across the pool surface. An insulated ball of this type is shown in U.S. Pat. No. 4,137,612 to Kelley. Spherical balls fail to cooperate in covering the entire pool surface.

In recognition of this shortcoming, it has been proposed to construct hollow balls with flat tangential surfaces disposed about the respective equators in expectation that the flat surfaces of adjacent balls might be engage one another and cooperate in covering the entire surface of the fluid body. Floats of this type are found in U.S. Pat. No. 3,998,204 to Fuchs et al. Balls of this type are relatively expensive to manufacture and problems are encountered from irregularities in the ball surfaces about their respective equators which often times cause them to ride up on top of each other during deployment thus preventing the respective balls from floating on the surface with their equators in the horizontal plane thereby preventing total and complete pool coverage.

Other efforts to provide for full surface coverage by individual floats led to the development of a blanket device made up of a plurality of individual cells, termed coverites in the form individual sealed bags of polyethylene plastic including a combination of water and translucent gas of air, with the walls of the individual coverites being flexible in anticipation that the coverites, when engaging one another, conform peripheral walls of adjacent neighbor's conform to one another to thereby cooperate in covering the surface of the pool. While an interesting concept, such devices would be relatively expensive to manufacture and have not been well accepted in the marketplace.

SUMMARY OF THE INVENTION

The present invention includes a plurality of small floats constructed of individual polygonal, horizontal, ribs formed with respective outwardly facing facets shaped and configured such that when they are deployed across the fluid surface the facets of the respective floats will engage facets of neighboring floats to cooperate in covering the pool surface. An arrangement of radial spokes and webs cooperate with the respective rims to form alternating axially oppositely opening air cells configured to, when the respective floats are floated on the fluid surface, capture air in alternating ones of the downwardly opening cells to cooperate in providing an insulating blanket across the surface of the fluid.

In some embodiments, the rims are hexagonal in shape. In the preferred embodiment, the spokes radiate inwardly from the rims and axially distal to cooperate in forming axially opposite edges which form laterally outwardly converging inclined ramps to cooperate, in the event various one of the floats should be deposited on top of one another, to cause any elevated floats to slide downwardly and outwardly on the upwardly facing ramps of any underlying floats to cause all floats to move to rest disposed horizontally on the pod surface.

BRIEF DESCRIPTION OF THE DRAWINGS

FIG. 1 is a perspective view of a thermal insulating float embodying the present invention;

FIG. 2 is a top plan view of the float shown in FIG. 1;

FIG. 3 is a left-hand side view of the float shown in FIG. 1;

FIG. 4 is a front view of the float shown in FIG. 1;

FIG. 5. is a vertical sectional view, in enlarged scale, taken along the line 5-5 of FIG. 2;

FIG. 6 is a vertical sectional view, in enlarged scale, taken along the line 6-6 of FIG. 2;

FIG. 12 is a transverse sectional view, in enlarged scale, taken along the line of 12-12 of FIG. 11;

FIG. 13 is a sectional view taken along the line 13-13 of FIG. 12;

FIG. 14 is a partial sectional view, in enlarged scale, taken from the line 14-14 of FIG. 13;

FIG. 15 is a sectional view taken along the line 15-15 of FIG. 12;

DETAILED DESCRIPTION OF THE PREFERRED EMBODIMENTS

Figure 7:
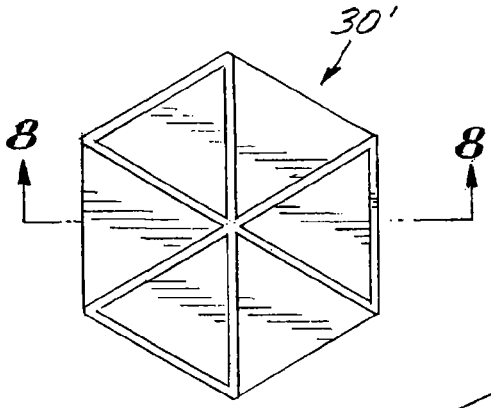
FIG. 7 is a top plan view of a second embodiment of the insulating float of the present invention.

Referring to FIGS. 1 and 5, the thermally insulating float 30 of the present invention, includes, generally, a peripheral rim 35 configured with like outwardly facing facets 37 and incorporating radial spokes 39 cooperating with the rim to form axially extending triangular pie shaped tubes. Referring to FIGS. 5 and 6, alternating ones of the tubes are covered on their respective axially opposite ends with horizontal webs 41 and 43 disposed in axial spaced apart planes and configured to cooperate with the respective rims 37 and spokes 39 to form oppositely opening air cells, generally designated 45 and 47, respectively. Consequently, the floats may be deployed across the surface of a pool, generally designated 51 (FIG. 21) with either axial end thereof facing downwardly to capture air in the respective downwardly facing cells 45 or 47 to thus provide thermal insulation and, also in some embodiments provide buoyancy of the individual floats.

The floats of the present invention may be referred to as mini floats and may be constructed of any desired material such as a polyolefin, for example polyethylene or polypropylene. In one of the preferred embodiments the polyolefin has a specific gravity greater than that of water which presents a negative buoyancy. The walls defining the peripheral rims 35 and spokes 39 take many shapes and configurations and, in some embodiments are configured of a relatively thin skin on the order of just a few thousands of an inch to a thickness of 0.010 inch or more.

The rims 35 have an axial extent which may be on the order of 5/16' of inch and terminate in respective opposite axial edges. The facets 37 will have a configuration and dimension which is uniform in the various floats and which may present, in plan view, any polygonal configuration which will, when the floats are deployed, cooperate in causing the family of floats to cover the entire pool surface. The rims may cooperate to exhibit in plan view, for instance, an equilateral triangle, a square or prior plan or the polygonal shape depicted in FIGS. 1 and 2.

In each instance, it is desirable that the tubes defining the respective cells 45 and 47 are of a substantially uniform shape and be arranged symmetrically about the longitudinal central axes of the respective floats to thus produce a balanced buoyancy on the individual floats.

In the preferred embodiment, the spokes 39 are fan shaped in vertical cross section radiate outwardly from a central axial post 44 at the respective outer extents to, join the respective corners 57 formed between adjacent facets 37 and are fared in at the respective axial edges of the respective facets. The opposite axial edges 59 of the spokes cooperate together in forming a generally frusto-conical or pyramidal outline (FIG. 1).

Referring to FIG. 5, alternate ones of the respective webs 41 and 43 are, in the preferred embodiment, disposed in respective horizontal planes displaced axially from one another a distance about equal to the axial length of the respective rims 37 to thereby cooperate in forming the respective cells 45 and 47 with respective volumes which are more than adequate to collectively trap sufficient air to float the respective floats elevated in the surface of the pool to float approximately ½ the axial length of the respective rims 35 elevated above the top surface of the pool water.

Referring to FIGS. 1, 5, 12 and 16, it will appreciated that the individual floats may be stored in a storage container, generally designated 57, defining a storage compartment 59. Referring to FIGS. 11-15, the storage container 57 is conveniently constructed with a horizontally disposed cylindrical tank 81 configured on its top side with a horizontal, tangentially projecting, laterally elongated, outlet chute 83 terminating in the transversely projecting mouth 61.

Figure 11:
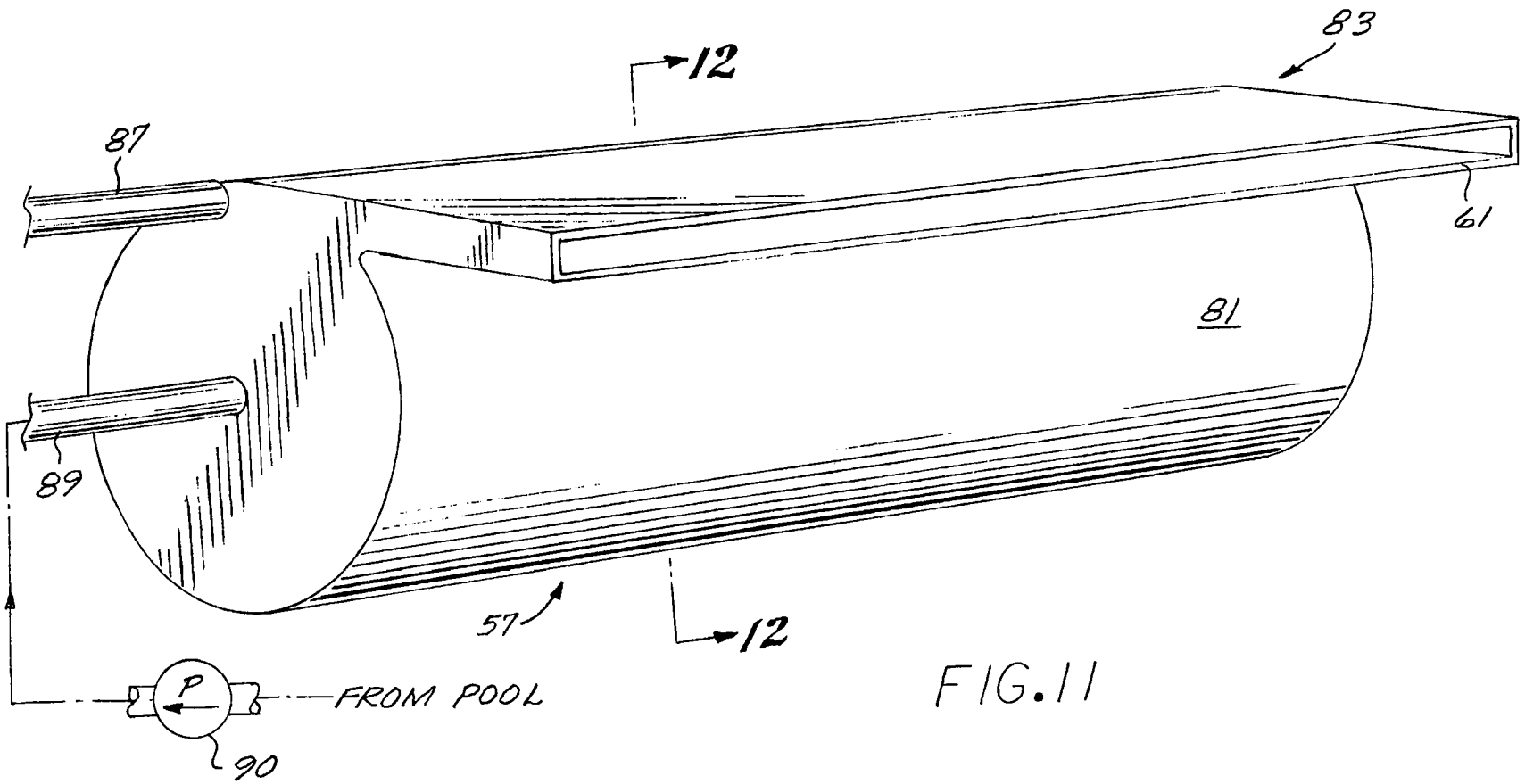
FIG. 11 is a perspective view of a storage container for storing the floats of the type shown in FIG. 1.
Figure 21:
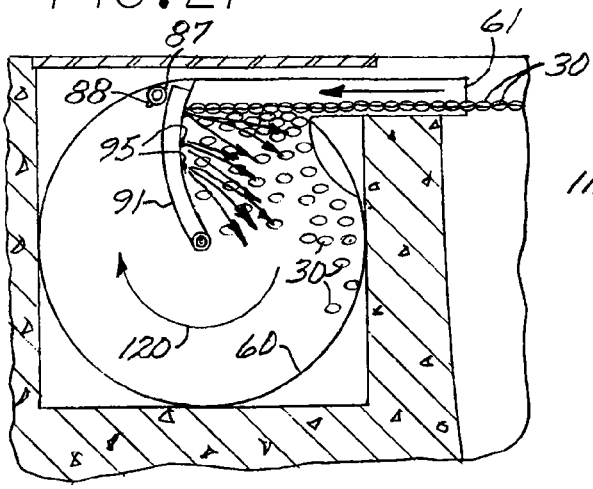
FIG. 21 is a vertical sectional view taken along the line 21-21 of FIG. 20.

Referring to FIGS. 11 and 21 in detail, connected to one end of the horizontal tank 81 at the top thereof is a discharge pipe 87 and connected centrally is an inlet pipe 89 which connects with an interior manifold 91 mounting a plurality of jets 95 spraying water into the tank to facilitate drawing of the floats back into the tank for retrieval.

Mounted in spaced relationship about the periphery of the pool 51 are a plurality of current control devices, generally designated 101 (FIG. 27), including respective intake tubes 103 covered at their open ends by flapper valves 105. Branched off from the intake tubes 103 are respective nozzle elbows 107 internally threaded at their distal ends to receive respective nipples defining spray nozzles 111. Control to the elbows 107 is controlled by respective one way ball check valves, generally designated 115.

When it is desirable to cover the pool surface a fluid pump 90 in the plumbing may be actuated to spray jets out the nozzles 88 (FIG. 17) to push the floats 30 from the compartment 60 to drive them out the horizontal outlet 61 and to draw fluid in the respective intake tubes 103 to open the flapper valves 105 so the pump can draw current 106 across the pool (FIG. 18) to draw the floats across the surface of the pool to be drawn into the distal, curved recesses of the pool and around any obstacles such as island 58. As the floats 30 are as flowed across the pool surface under the influence of the current they will be positioned adjacent one another with the respective facets 37 in complimentarily contacting arrangement to thereby cooperate in covering the entire surface.

As will be appreciated by those skilled in the art, the construction of the individual floats 30 cause the alternating individual cells 45 which open downwardly in the respective floats (FIG. 5) to capture air therein to thus cooperate in maintaining the respective floats floating horizontally on the pool surface. It will be appreciated that as the floats are deployed there will be a certain degree of jostling and sometimes irregular current and, in many instances, atmospheric winds and disturbances which will tend to rock the floats from one side or the other causing different ones of the floats to tend to float into intimate contact against their respective neighbor.

In the preferred embodiment, the floats are constructed to be symmetrical about their respective vertical axes and are also symmetrical on the top and bottom sides about a horizontal plane taken transversely through the middle of the floats. As will be appreciated from FIGS. 5 and 6, the respective spokes are formed from vertical planer sections such that, when floating on the surface of the fluid, the bottom portions thereof diverge outwardly from the center in radial fashion with the planer sides thereof acting as fins so that when current strikes in one direction or another on the surface of the fins, the respective fins configured with surfaces facing the current, will be impacted by the current to thereby tend to urge the floats positively in the direction of the current thus facilitating deployment of the floats across the pool surface.

Because the floats are relatively short in their axial directions there is a risk that, as they are deployed and jostled about by any water disturbances or wind that the bottom of one side or another of the floats may come to rest on the top side of a neighboring float thus disrupting the uniform deployment across the water surface. In this regard, it will be apparent that, with the respective outwardly and downwardly inclined spoke ramps 59 on the top sides of the respective floats cooperating to form a respective revolutions defining conical outlines when one float lands on another, the ramps of adjacent floats will tend to cause the lower most float to ride out from beneath the elevated neighboring floats so that the overall cooperation will tend to laterally displace any elevated floats or portions thereof thereby maintaining the floats in their desired horizontal positions on the surface of the pool to cooperate in forming the composite blanket configuration. With this covering, the entire surface will be blanketed with nearly 50% of that surface further insulated from the atmosphere by means of the air trapped in the downwardly opening cells 45.

As will be apparent to those skilled in the art, the floats of the present invention may come in many different sizes and shapes. In one of the preferred embodiments, the horizontal facets 37 are 2½ centimeters long and the rim 35 has a width between opposite facets of 4½ centimeters. The axial length at the center is post 3 centimeters and the wall thickness of the rim, floats, and webs is approximately 0.10 centimeters.

Referring to FIG. 7, in some embodiments, the horizontal webs 40 and 42 of the float 30' are covered with an opaque coating 46 on at least one side and in other embodiments the entire float itself is opaque or of black coloration, such as by coating, to provide for absorption of solar radiation to thereby enhance heating of the body of fluid. The bottom end of the post 44' may be formed with an enlarged-in-cross section sinker 70 (FIG. 8) to ballast the floats biased with the opaque coat facing upwardly.

Figure 8:
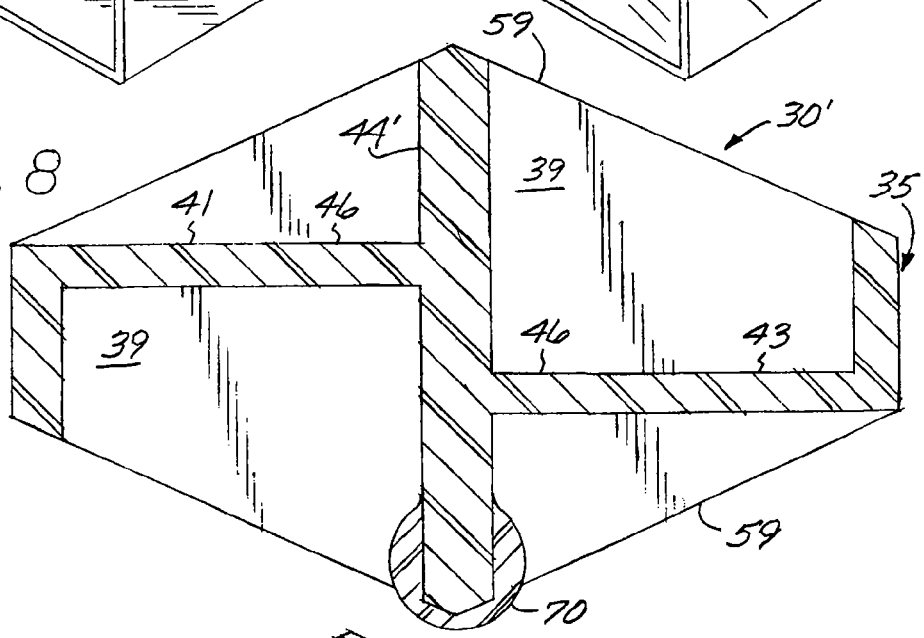
FIG. 8 is a vertical sectional view, in enlarged scale, taken from the line 8-8 of FIG. 7.

Referring to FIG. 8, the float 30' is formed with the vertical spokes also covered with an opaque coating to further facilitate absorption of the radiation.

Figure 9:
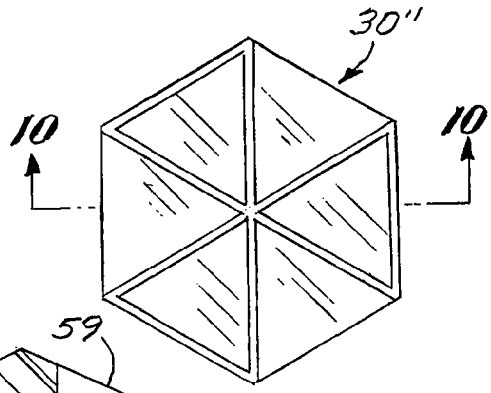
FIG. 9 is a top plan view of a second embodiment of the insulating float of the present invention.
Figure 10:
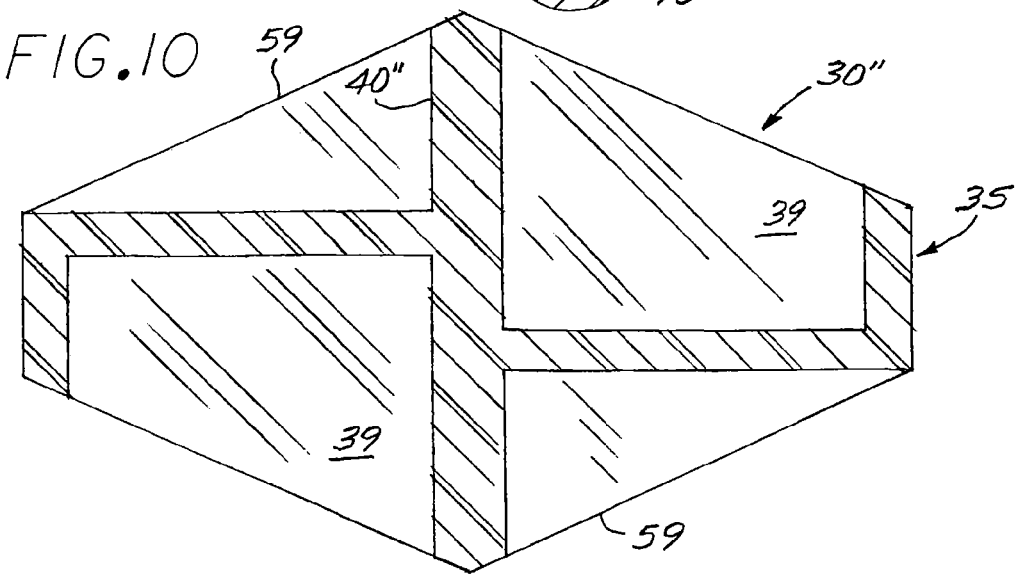
FIG. 10 is a vertical sectional view, in enlarged scale, taken from the line 10-10 of FIG. 9.

Referring to FIGS. 9 and 10, in some embodiments, at least the horizontal webs 41 and 43 of the floats 30" are transport and in some embodiments the spokes are also transparent (FIG. 10).

Figure 16:
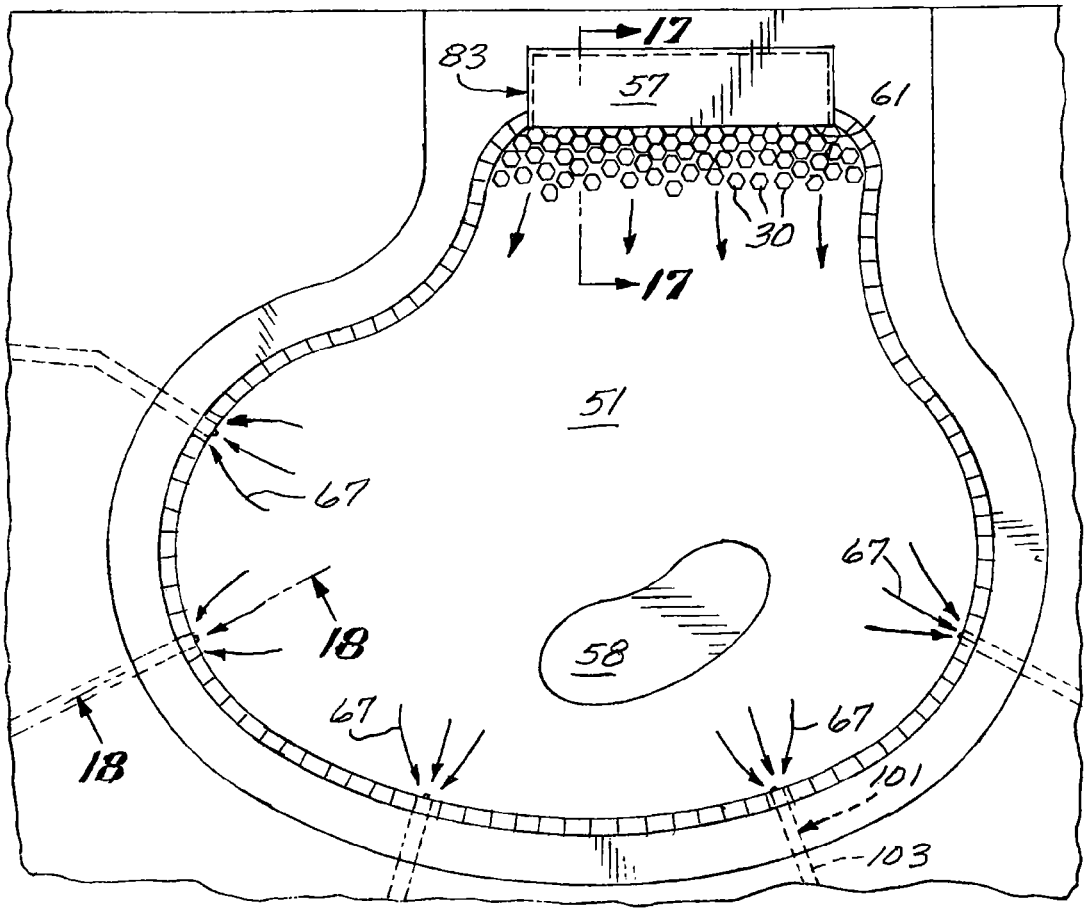
FIG. 16 is a top plan view of a pool, in reduced scale, to be covered by floats of the type shown in FIG. 1.
Figure 17:
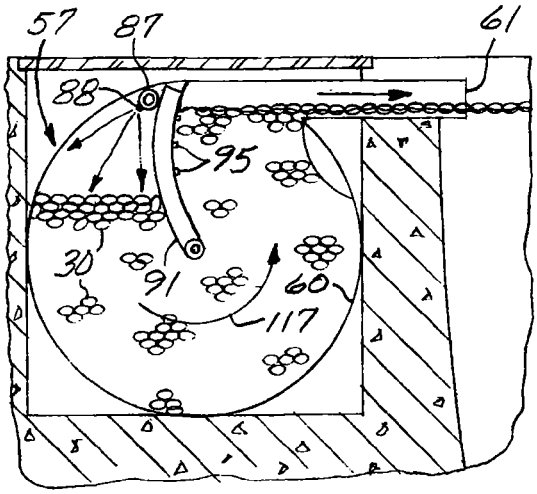
FIG. 17 is a vertical sectional view, in enlarged scale, taken along the line 17-17 of FIG. 16.
Figure 18:
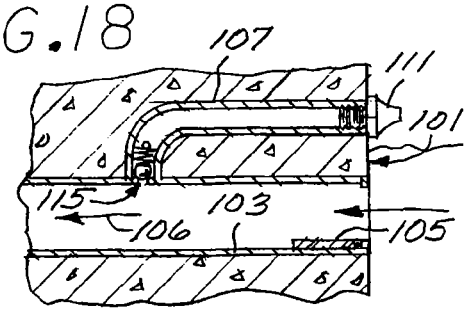
FIG. 18 is a vertical sectional view, in enlarged scale, taken along the line 18-18 of FIG. 16.
Figure 19:
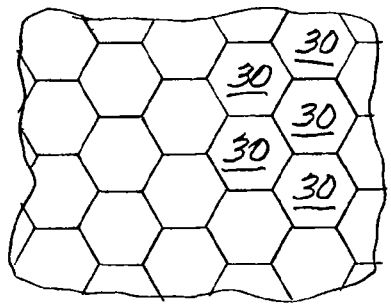
FIG. 19 is a top plan view, in enlarged scale, of floats shown in FIG. 16 but depicted in their abutting, covering relationship.
Figure 20:
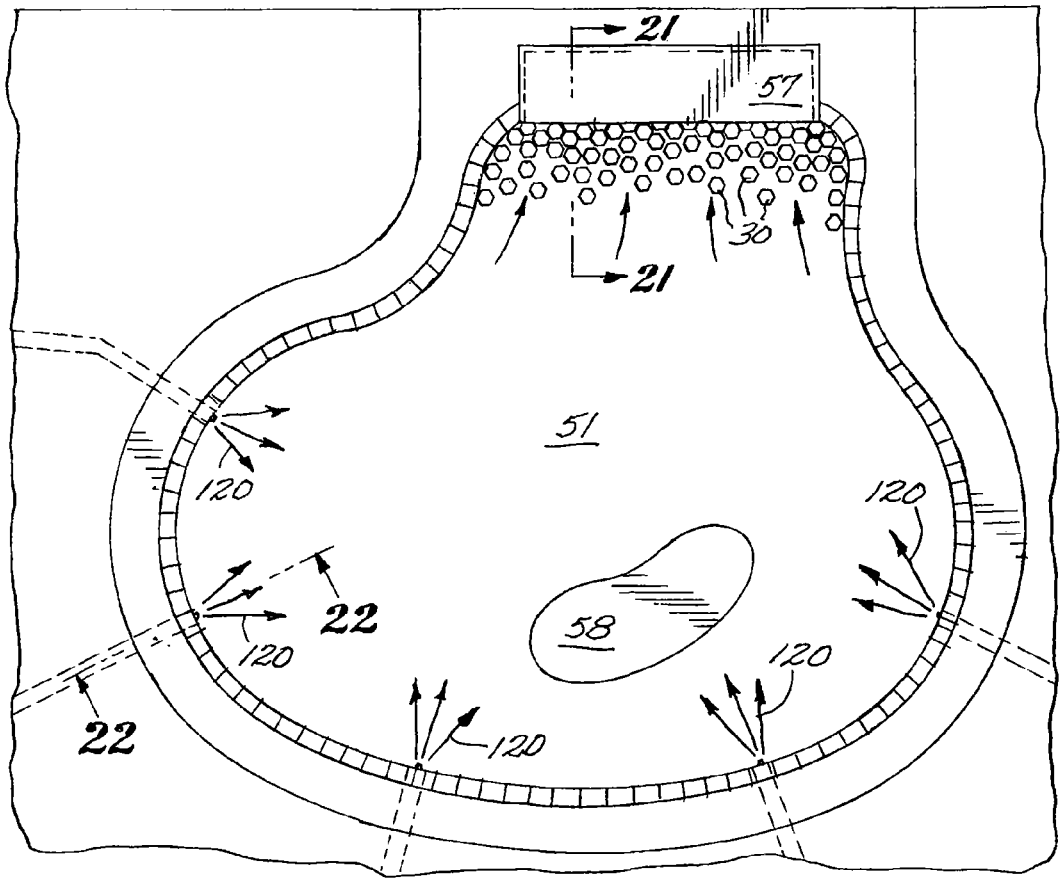
FIG. 20 is a top plan view similar to FIG. 16 but showing the floats being retracted.

In operation, it will be appreciated that the mini floats 30 will be stored in the tank 81 as shown in FIG. 17. When it is desirable to deploy the floats, the water pump may be actuated to initiate flow from the discharge nozzle 88 (FIG. 17) to induce circulation of the water in the direction of the directional arrow 117 toward the chute 83 to be dispensed out the mouth 61 as shown in FIGS. 16 and 17 to thus enter one side of the pool 51 as shown in FIG. 21. Concurrently, the water pump will draw water into the respective inlet tubes 103 as shown in FIG. 18, past the open flapper valve 105 to thereby generate a surface current which tends to draw the respective floats from the mouth 61 toward the remote sections of the pool as depicted in FIG. 16 to, after a short period of time, cover the entire pool surface. This pumping action can be controlled by a timer and once sufficient flow has been undertaken to fully deploy the floats and nest them into their abutting relationship covering the entire pool surface, the pump will be turned off to leave the floats in covering relationship blanketing the top surface of the pool.

Referring to FIGS. 7 and 9, it will be appreciated that, for those floats 30' with the top surfaces of the webs coated by the radiation absorbing coating, the respective weights defining the sinkers 70 on the bottom side of the respective posts 44' will tend to weight the floats in their upright position with the top coating on the top side of the respective webs. As will be appreciated by those skilled in the art, the weighting of the bottom side of the respective floats may be numerous different means, such as by increased cross section of the respective spokes, addition of a metallic weight or any other means known to those skilled in the art.

For those embodiments of the float 30' were the radiation is absorbed, it will be appreciated that during a day when the sun's radiation is striking on the opaque coating, the radiant heat thereof will be absorbed and, particularly for those cells with the respective webs in direct contact with the water itself, the absorbed heat will be transferred in the body of the pool to thus tend to maintain a higher temperature for the comfort of the swimmers.

During cooler periods, such as in the evenings and night time when the atmosphere is substantial cooler than the water itself, the stagnant air trapped in the respective downwardly opening cells will serve as a thermal insulator to block the escape of heat from the pool to thereby the minimize the loss of heat and tend to maintain the temperature of the pool at an elevated temperature to thereby minimize the aid for use of heaters to heat the water for comfort of the users.

Figure 22:
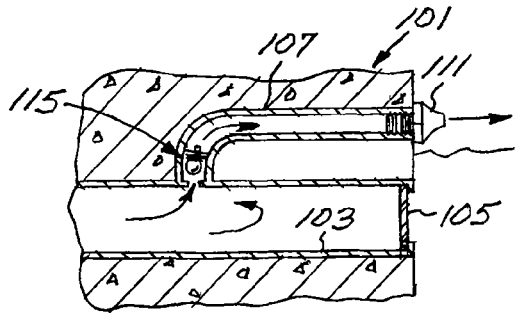
FIG. 22 is a vertical sectional view, in enlarged scale, taken along the line 22-22 of FIG. 20.

When it is desirable to use the pool, the pump may be actuated and the valving manipulated to spray water from the respective nozzles 95 of the manifold 91 (FIG. 21) to initiate circulation of the water in the direction of the directional arrow 120 in FIG. 21 to thereby tend to draw water current into the mouth 61 along the chute 83 to thereby draw the floats into the storage tank 81. Simultaneously, the water pump will pressurize the respective inlet tubes 103 to close the respective flapper valves 105 and open the respective check valves 115 to introduce water flow through the respective nozzles 111 (FIG. 22) to the pool surface in the direction of the respective directional arrows 126 in FIG. 25 to thus facilitate herding of the floats 30 from the remote areas of the pool and back into the mouth 61 through the chute 83 into the tank 81.

From the foregoing, it will be appreciated that applicant's blanket of self aligning floats provides a economical and effective means for insulating the surface or interface of a fluid and that the system for disbursement and collection thereof provides an effective means for deployment and recovery of the floats.

I claim:

1. A thermal insulating pool blanket comprising:

polygonal float devices including respective parametrical rims symmetrical about respective central axes, formed with a plurality of horizontally elongated, laterally outwardly facing vertical facets of equal length, adjacent facets joining at respective corners to define a predetermined number of corners, a predetermined number of spokes radiating outwardly from the respective axes to join the corners at their respective distal ends, adjacent spokes cooperating with the respective rims to form therebetween respective axially elongated tubes defining respective axially opposite ends, the spokes being formed with axial opposite edges defining respective ramps sloping symmetrically outwardly from the axes and axially toward one another to fare into the respective rims at the respective corners, the float devices including at alternating opposite ends of the tubes transverse webs spanning between the respective adjacent ribs and the respective rims to cooperate in defining air cells open at the respective ends of the tubes opposite the respective opposite ends whereby the floats may be dispersed onto a surface of a pool with their respective opposite axial sides randomly facing downwardly causing the open ends at the alternating opposite ends to capture air in the respective alternate ones of the respective air chambers.

2. The thermal insulating pool blanket as set forth in claim 1 wherein:

the polygonal floats are constructed with the respective facets cooperating to, in plan view, define respective hexagonal shapes.

3. The thermal insulating pool blanket as set forth in claim 1 wherein:

the floats are constructed with a negative buoyancy.

4. The thermal insulating pool blanket of claim 1 wherein: the webs are transparent.

5. The thermal insulating pool blanket of claim 1 wherein: the webs are opaque on at least one side.

6. The thermal insulating pool blanketed to claim 1 wherein:

the webs are opaque on one side; and the floats are configured on their respective sides opposite the one side with respective weights to provide ballast.

7. An insulating pool blanket comprising:

a plurality of like polygonal floats including respective parametrical rims, formed with respective like outwardly facing facets symmetrical about respective longitudinal axes and including a plurality of respective axial spokes cooperating with the respective rims to form respective axial tubes and webs spanning between respective adjacent spokes and rims to cooperate with the respective rims and spokes to form air cells arrayed about the respective floats and alternatively opening in respective opposite axial directions.

8. The insulating pool blanket of claim 7 wherein:

the floats are constructed with a symmetrical configuration on the top and bottom sides thereof.

9. The insulating pool blanket of claim 7 wherein:

the floats are formed at their respective upper and lower extremities with respective fins.

10. An insulating pool blanket comprising:

a plurality of like polygonal floats comprising respective parametrical rims terminating in opposite axial rim ends and formed with a plurality of uniform outwardly facing facets, symmetrical on opposite sides about respective longitudinal axes and spokes radiating outwardly from the respective axes and cooperating with the respective rims to form equal size axial tubes disposed symmetrically on opposite sides of the respective axes and terminating at their respective opposite axial ends in first and second edges converging laterally outwardly away from the respective axes toward one another to join respective opposite ends of the rim, and webs covering alternating ends of the respective tubes to cooperate in forming respective air cells opening in the axial direction away from the respective webs to, upon the floats being deployed across the surface of a pool to nest against one another and complimentary engage the adjacent ones of the facets to cooperate in covering the entire pool surface and trapping air in any downwardly opening cells to provide thermal insulation.

11. The insulating pool blanket as set for the in claim 10 wherein:

the respective rims are constructed to form the respective facets to cooperate in plan view to form respective hexagonal patterns.

12. The insulating pool blanket as set for the in claim 10 wherein:

the webs at the respective ends of the alternating ones of the respective tubes are disposed in respective common planes.

13. The insulating pool blanket as set for the in claim 10 wherein:

the rim is formed with the adjacent facets configured to join at respective corners; and the spokes radiate outwardly to join the respective rims at respective corners.

14. A system for covering the surface a body of fluid comprising:

a plurality of individual like floats configured with respective parametrical rims and so configured as to, when the rims are floated on the surface, cooperate in covering the surface, the floats further including respective interior networks of radial spokes and webs cooperating to form cells opening alternately in opposite axial directions, and so configured to cooperate with the respective rims to, when the respective floats are floated on the surface with either of the axial sides of the respective floats facing downwardly, capture sufficient air in the cells which open downwardly to cooperate in floating the respective floats on the surface;

a storage device container for storing the floats and including an opening for deploying and retrieving the floats;

a fluid pump device for selectively driving fluid current out and in the opening for selectively driving the floats out the opening and for drawing current in the opening.

15. The system of claim 14 that includes:

spray nozzles about the body of fluid for controlling fluid current on the surface to control the paths of travel for the respective floats.

16. The system of claim 14 wherein:

the storage device includes a tank to be filled with the fluid;

the fluid pump device includes a series of spray nozzles for spraying the fluid to direct fluid current in the tank to draw current in the opening; and a deployment nozzle to drive fluid out the opening.

17. The system of claim 14 wherein:

the storage device includes a horizontally elongated chute terminating in a horizontally elongated opening for deployment of the floats.

18. The system of claim 14 wherein:

the fluid pump device includes a fluid control device including a plurality of fluid control devices disposed about the perimeter of the body of fluid, each including a retrieval tube valve for selective opening at the tube and the pump device is operative to open the respective valves and draw fluid from the fluid body, the fluid control devices further including a respective branch tube terminating in respective nozzles to spray fluid on the surface of the pool to generate respective currents tending to drive the floats toward the opening, and check valves for controlling flow from the respective deployment tubes to the branch tubes.

19. The system of claim 14 wherein:

the pump device includes spray nozzles in the storage container for spraying fluid therein to tending to flow the floats from the container onto the fluid surface.

20. The thermal insulating pool blank set forth in claim 1 wherein the devices are constructed of one piece.

21. An insulating pool blanket comprising:

a plurality of like polygonal floats including respective parametrical horizontal rims projecting axially to terminate in respective top and bottom edges;

the floats being formed with respective medial horizontal planes and formed with respective like outwardly facing facets symmetrical about respective longitudinal axes;

axial posts disposed in the respective axes and projecting vertically outwardly beyond the respective top and bottom planes to terminate in top and bottom ends;

a plurality of respective triangular shaped axial spokes having respective opposite edges tapering laterally outwardly from the respective top and bottom ends to the respective top and bottom edges and cooperating with the respective rims to form respective open-ended axial tubes;

webs spanning between respective adjacent spokes and rims to cooperate with the respective rims and spokes to form air cells arrayed about the respective floats to form openings alternatively opening in respective opposite axial directions;

the webs of alternate ones of the cells being disposed in a first common horizontal plane spaced in one axial direction from the medial plane away from the openings of the respective alternate cells;

the webs of the remaining cells being disposed in a second common plane spaced axially from the medial plane opposite the one direction.

22. The insulating pool blanket of claim 21 wherein the thickness of the rim and webs is approximately 0.010 inches.

* * * * *